United States Patent [19]

van Eek et al.

[11] 4,191,266

[45] Mar. 4, 1980

[54] PROCESS AND INSTALLATION FOR DRILLING HOLES IN THE EARTH'S CRUST UNDER FREEZING CONDITIONS

[75] Inventors: Wouter H. van Eek, Wassenaar; Arnold W. J. Grupping, Aerdenhout, both of Netherlands

[73] Assignee: Wouter H. van Eek, Wassenaar, Netherlands

[21] Appl. No.: 882,621

[22] Filed: Feb. 28, 1978

[30] Foreign Application Priority Data

Mar. 4, 1977 [NL] Netherlands ..... 7702354

[51] Int. Cl.[2] ..... E21B 7/00

[52] U.S. Cl. ..... 175/17; 175/7; 175/72

[58] Field of Search ..... 175/17, 65, 67, 69, 175/72, 206; 166/302, DIG. 1

[56] References Cited

U.S. PATENT DOCUMENTS

| | | | |
|---|---|---|---|
| 2,193,219 | 3/1940 | Bowie et al. | 175/17 |
| 2,576,283 | 11/1951 | Chaney | 175/17 X |
| 2,621,022 | 12/1952 | Bardill | 175/17 |
| 3,175,628 | 3/1965 | Dellinger | 175/72 |
| 3,183,971 | 5/1965 | McEver et al. | 166/302 X |
| 3,424,254 | 1/1969 | Huff | 175/17 |
| 3,533,480 | 10/1970 | Chenevert et al. | 175/66 |
| 3,618,680 | 11/1971 | Ellard et al. | 175/17 |
| 3,618,681 | 11/1971 | Bartlett | 175/17 |

FOREIGN PATENT DOCUMENTS

| | | | |
|---|---|---|---|
| 521952 | 8/1953 | Belgium | 175/17 |

OTHER PUBLICATIONS

T. R. Wright, Jr., Guide to Drilling Workover and Completion Fluids, World Oil, Jan. 1977.

*Primary Examiner*—James A. Leppink
*Assistant Examiner*—Richard E. Favreau
*Attorney, Agent, or Firm*—Cushman, Darby & Cushman

[57] ABSTRACT

Process for drilling a hole in the earth's crust in which the bottom of the drill hole is frozen in front of or near the drill bit by a cold drilling liquid in which liquid particles that have been frozen to solid parts or have been solidified have been taken up whether or not by addition. In this way the bottom of the drill hole is always so hard — also upon drilling in soft or plastic formations, such as clays, — that use can be made of diamond drill bits or other drill bits normally used for hard formations, in order that the number of times a drill bit is to be replaced can be strongly reduced. The purpose of adding ice is to make it possible for a sufficient amount of frigories per unit of time to be introduced into the drill hole, so that at greater depths the temperatures at the drill bit are decreased to such a degree that here, too, use can be made of drill bits for hard formations here described.

By preference, the drilling liquid is a mud consisting of an eutectic salt water solution with plastering properties, to which ice of the same composition has been added.

The pressure in the drilling liquid in the bottom of the drill hole is somewhat lower than the pressure of the liquid in the drilled formation, so that during the drilling the drilling liquid cannot penetrate into the layer, but a slight influx of water from permeable rocks can take place, as a result of which all drilled layers, both permeable and non-permeable ones, will be frozen. The lower pressure on the bottom of the drill hole is achieved by injecting a gas, in the cirulating drilling liquid to reduce its (mass) density. Regulation of the pressure in question may take place with the aid of a throttling element which controls the over-pressure required at the top of the annular circuit between the drilling string and the drill hole wall.

The invention further relates to an installation for realizing the process according to the invention. This installation is mainly characterized by means included in the drilling liquid system at the ground level to cool drilling liquid and change it partly to ice, by means to add a gas to the drilling liquid, and by means to control the overpressure at the top of the annular circuit between the drilling string and the drill hole wall.

The process according to the invention may be applied in any production process for recovering energy, such as production of oil or natural gas, thermal energy and thermal energy from coal formations and oil shales or oil sands.

21 Claims, 2 Drawing Figures

PROCESS AND INSTALLATION FOR DRILLING HOLES IN THE EARTH'S CRUST UNDER FREEZING CONDITIONS

BACKGROUND OF THE INVENTION

The invention relates to a process for drilling holes in the earth's crust with a drill bit, with use of cold drilling liquids to be applied in any process for recovering energy.

It is known for holes to be drilled in the crust of the earth with use of cold drilling liquids so that the wall of the drill hole is frozen. Certain clay formations, which are unstable if non-cooled drilling liquids are used and affect the drilling process detrimentally, retain their coherence and stay in place. Also, if these cold drilling liquids are used cores can be extracted from unconsolidated rocks with a higher yield since these cores freeze and do not disintegrate easily during the drilling process.

It will be clear that the temperature of the circulating medium should be lower than the freezing point of the liquid contents of the formation to be frozen and equal to or higher than the freezing point of the circulating medium itself. For drilling liquid use may be made of various liquids, such as salt water, a salt water—mud flush, oil, e.g. Diesel oil, or a water/oil emulsion. Chilling of the drilling liquid may take place according to known methods; solid carbon dioxide is often used for this purpose. The drill pipes may have been provided with insulation material in order to effect transportation of as much cold as possible to the bottom of the drill hole.

A problem not connected with this is the drilling of holes having a small diameter (so-called 'slim holes'0 through formations comprising soft or plastic clays, or soft shales (slates). Under these conditions so-called insert drill bits, diamond drill bits or other drill bits suitable for drilling hard formations can make little progress as a result of the so-called 'balling up' effect. In order to keep the drill bit as long as possible at the bottom of the drill hole it is desirable, just because of the slight wear, to use one of these types of drill bit. Generally, the diamond drill bit will be preferred because of the absence of bearings.

SUMMARY OF THE INVENTION

It is one of the objects of the invention to make the drilling of holes possible in formations comprising clays, soft shales or soft formations of this kind with use of drill bits more suitable for hard formations.

According to the present invention holes are drilled in formations comprising soft or plastic clays, soft shales (slates) or soft formations of this kind with a drill bit for harder rock formations if the cold drilling liquid always contains an amount of frigories sufficient to freeze at least part of the rock near the drill bit. The present invention especially relates to relatively small bore/-holes with diameters of 200 mm (8") or less (e.g. 'slim holes') but the method may also be applied for bore/holes exceeding that diameter if necessary. By preference, a diamond drill bit is used for drilling. It has appeared that, at least if the rock near the bottom of the drill hole has become frozen through withdrawal of an adequate amount of heat by the drilling liquid, the above-mentioned 'balling-up' effect does not occur. The disadvantage of using a diamond drill bit has here changed into an advantage. As the diamond drill bit may be rotated faster (e.g. 400 r.p.m. as against 100 to 200 r.p.m.) and the more rapid the drill bit is rotated the smaller the advance per revolution needs to be in order yet to achieve the same drilling progress as is the case with drill bits of a different kind. The result is that, owing to the slight advance per revolution, there is a better change of so freezing the clay and other little permeable formations of this kind in the vicinity of the drill bit head that the above-mentioned balling-up effect does not occur. In this connection it is noted that, as a rule, freezing of sands and similar permeable formations is not necessary to achieve the required drilling progress, seeing that, normally, these can be drilled with diamond drill bits without any difficulties.

The invention also relates to an installation which makes it possible to drill in formations containing clays or soft shales or soft rocks of this kind with the aid of drilling equipment which, normally, is meant for harder formations. The installation is characterized in that the drilling liquid system at the ground level comprises at least a cooler to prepare a cooled drilling liquid, an ice-machine to freeze part of the drilling liquid, and means to mix the cooled and frozen cooling liquid, force it through the system and feed it to the drilling line. Moreover, if so desired, a compressor or the like is present to add a gas to the drilling liquid. If desired, the cooler and the ice-machine may be combined into one apparatus. Finally, for control of the pressure in the drill hole, one or several packing glands and at least one adjustable throttling element, for instance in the connection before the separator, are present.

GENERAL CONSIDERATIONS OF THE INVENTION

The previously mentioned state of the art, known as such, for freezing the wall of drill holes with the aid of a cold flush might be applied to enable drilling of clays or soft shales with drill bits that are suitable for drilling hard formations. However, this known freezing method involves the drawback that the quantity of cold that can be added to the drilling liquid is rather slight. Since the temperature in the earth's crust rises as the depth increases, it will no longer be possible below a certain depth to supply a sufficient amount of cold at a low temperature to adequately freeze the environs near or at the bottom of the drill hole. Said method, therefore, is only suitable for freezing holes of little depth.

A further object of the invention is to make the process—for causing the cold drilling liquid always to contain enough frigories to be able to freeze at least part of the rock near the drill bit head—more definite and, hence, to render drilling with drill bits for hard rocks also possible in soft formations at a great depth. The frozen wall of the drill hole then takes over the function of the customary steel casing to such an extent that it will be possible to drill to a great depth without lining pipes. In this way a hole can always be started with a drill bit having a small diameter. This is particularly favorable in case of off-shore drilling in a large water depth because only a riser system (the connection between the drilling vessel and the sea bottom) of a small size is required then which, therefore, may be of a light and easily handsome construction.

Freezing of the drill hole to a great depth is made possible according to the invention in that the drilling liquid contains liquid particles which have been frozen or solidified. The drilling liquid may consist of an organic liquid, such as oil, in which ice particles have been taken up. It may also be an oil/water emulsion whose water particles, in the first instance, are frozen. The frozen, aqueous component may be an aqueous salt solution, preferably of an approximately eutectic composition.

By preference, however, from the point of view of environmental and fire prevention, an aqueous salt solution for drilling liquid having an approximately eutectic composition, in which ice of practically the same composition as the liquid has been taken up, will be preferred.

In this way the melting-cold of the (eutectic) ice will be added to the cold effect of the drilling liquid, as a result of which more frigories per unit of time can be introduced into the drill hole. As a basis for preparing eutectic flushing ice, solutions of many salts or mixtures of salts may be frozen, like aqueous solutions of NaCl, $MgCl_2$ or $CaCl_2$. For instance, eutectic ice of sodium chloride is a suitable medium: it has a melting point of minus 21.12° Celsius.

The (eutectic) ice is prepared at the surface by one of the methods known from technical science and is added in finely divided state to the drilling liquid, which has also been given the same low temperature, whereupon they are pumped, together, into the drill hole through the drilling string. Along with the drilling liquid not frozen originally and the drill cuttings, it proceeds as drilling liquid, after having been melted, via the annular space between the drilling string and the drill hole wall to the outside, where the drill cuttings are sieved off or removed as much as possible in another manner. Next, part of the purified drilling liquid is passed to the ice-machine and refrozen. The remainder of the drilling liquid is given about the eutectic temperature in a cooler, following which the two materials are mixed and again pumped into the hole. Thus a continuous cycle in a closed system is formed. It may be preferable to pass the entire flush through the ice-machine and freeze a portion.

The invention is further characterized in that during the freezing the issue of liquid into the formation or influx of formation water at or near the bottom of the hole is limited as much as possible. A liquid stream as referred to here may affect the freezing detrimentally, for instance because the non-freezing salt solution penetrates into the formation, and is also undesirable for other reasons, like the dilution of the drilling liquid. For this reason care is taken that the pressure of the liquid column in the annular space between the drilling string and the drill hole wall at the bottom of the hole is about equal to the prevailing pressure of the liquid contents of the rock through which the drilling takes place. Preferably, even a slightly lower pressure is applied.

The result aimed at can be achieved if the liquid column in said annular space has a low (mass) density, lower than that of the eutectic salt solution. The low (mass) density can be obtained by adding a gas, such as air or nitrogen, to the drilling liquid circulating downwards through the drilling string. Owing to the gas added the drilling liquid forms more or less a foam to which, if so desired, stabilizers have been added. The gas may also be added as a liquid in a cooled condition, which even increases the cooling or the cooling effect of the drilling liquid. Instead of a gas, also a light, immiscible, emulsion-forming liquid may be added to the aqueous drilling liquid, for instance a hydrocarbon, such as kerosine or Diesel oil.

If the (mass) density of the liquid is chosen sufficiently low and the top of the annular circuit is provided with one or several packing glands with continuously adjustable throttling elements, the pressure of the column at the bottom of the hole can be controlled. The overpressure prevailing at the throttling element can be so set that this pressure plus the pressure of the foam liquid column plus the frictional losses in the annular space together amount to slightly less than the pressure of the formation water.

This is explained in more detail in FIG. 1 of the drawing. This figure shows a graph. In this graph the depth below the ground level M is plotted on the vertical axis; on the horizontal axis the hydraulic pressure of the formation water ((mass) density=1). Line a. represents this pressure at an increasing depth. Point A. thus represents the pressure at x meters of depth (e.g. a pressure of 20 MPa at a depth of 2000 m.). Line b. represents the pressure of the liquid in the annular space at the same depth, if the liquid consists of an eutectic salt mixture (e.g. a pressure of $1.2 \times 20 = 24$ MPa at a depth of 2000 m if the (mass) density of the liquid is 1.2). Point C. of the line c. now renders the pressure if the liquid column is less in weight by addition of a gas and thus forming a foam. The distance C–M is the pressure which will occur at the throttling element when the pressure of the liquid column at the bottom of the hole is equal to the formation pressure. Line C′ represents the course of the pressure if the pressure at the bottom of the hole is slightly lower than the formation pressure. The distance C′–M is the pressure then prevailing or required at the throttling element. Point S. indicates at what depth the under-pressure changes into over-pressure referred to the formation pressure. The lines b, c and c′ are showing static pressures without taken account of friction losses in the annular space.

The invention is further characterized in that during the extension of the drilling string with additional pipes the influx of formation liquid is temporarily prevented by freezing the drill hole wall down to the bottom if necessary by slightly raising the counter-pressure at the top of the annular system. Further, the said adjustable throttling element may be so designed that it reacts to the total quantity of drilling liquid present at the surface level. Control of the liquid levels in the various parts of the liquid system may be necessary for that purpose. Another means is the continuous determination of the salt content of the solution.

As already mentioned, it is also possible to use only a salt water flush with ice, in which case there will be an over-pressure in the bottom part of the drill hole. In this case loss of filtrate will occur in the permeable formation, such as sands, as a result of which these will no longer become frozen. Non-permeable rocks, like clays, however freeze even in this case, so that it remains possible to use diamond drill bits or other drill bits only suitable for drilling in harder formations.

It may then prove necessary, to avoid loss of drilling liquid, that this liquid contains one or several substances which plaster the drill hole wall. This can be achieved according to the invention by starting from the said eutectic liquid to which a cold-resistant clay component, such as attapulgite, and floc gel to improve the plastering has been added to form a mud.

In the same way that eutectic ice can be made from a eutectic salt solution with the aid of an ice-machine, ice can also be made from said mud in an ice-machine. This flushing-ice may then be mixed with cooled, not yet frozen drilling mud.

If in that case the mixture of ice and mud is reduced in weight—by means of gas injection or the addition of immiscible organic liquid—to such an extent that the pressure on the bottom of the drill hole is just slightly lower than the formation pressure, the flush with the plastering effect will not be able to penetrate into a permeable formation above point S of FIG. 1, so that this formation can yet be frozen. A packing gland with adjustable throttling element in the top of the annular circuit remains necessary.

If desired, connections can be made by shutting of the gas supply after the drill hole has for some time been made to freeze well at the drill bit, so that the flush which is then heavier cannot penetrate into the formation.

However, if one wants to freeze only the clay formations or other, little or not permeable layers, the drill hole can be deepened further also with said drilling liquid having the plastering effect without addition of a gas, which is an additional advantage because the mud as such already possesses good plastering properties, as a result of which non-frozen layers are yet plastered properly.

If the drill bit should encounter a layer at a certain depth containing liquid and/or gas subject to a much higher pressure than the hydrostatic pressure of the drilling liquid, it will be possible to shut off the hole by causing a packer, present in the drilling line at some distance from the drill bit, to expand against the circular, frozen wall of the drill hole, while the drilling pipes may, if necessary, be provided internally with a non-return valve. In this connection, also, it is more desirable to lighten the flush through addition of a gas to form a 'foam', instead of doing this with Diesel oil or kerosine. If the drilling should suddenly reach layers in which a higher pressure prevails the gas supply can be cut forthwith. Even upon thawing of the drill hole wall the said mud with its good plastering properties will, normally, not cause any appreciable losses. Finally, by applying a gas, separation of gas in the surface installation is simpler than separation of kerosine or Diesel oil, although all this depends on the degree to which foam-stabilizing chemicals have been added.

BRIEF DESCRIPTION OF THE DRAWING

The invention will be elucidated with the aid of a drawing, wherein.

DESCRIPTION OF A PREFERRED EMBODIMENT

Figure 1:
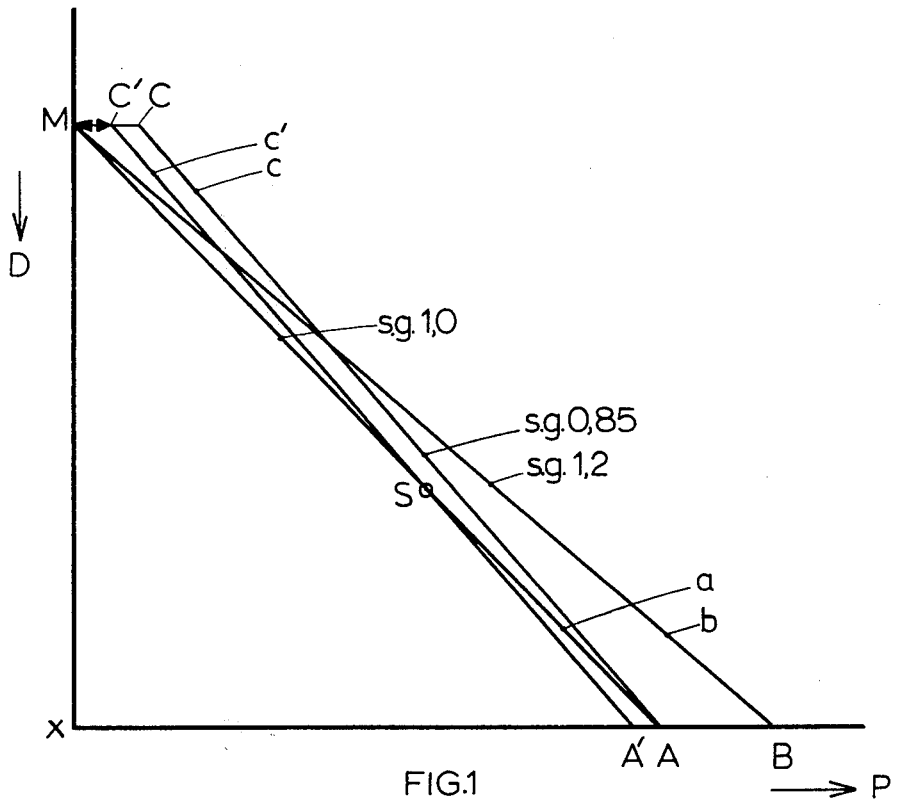
FIG. 1 shows a graph as already mentioned.
Figure 2:
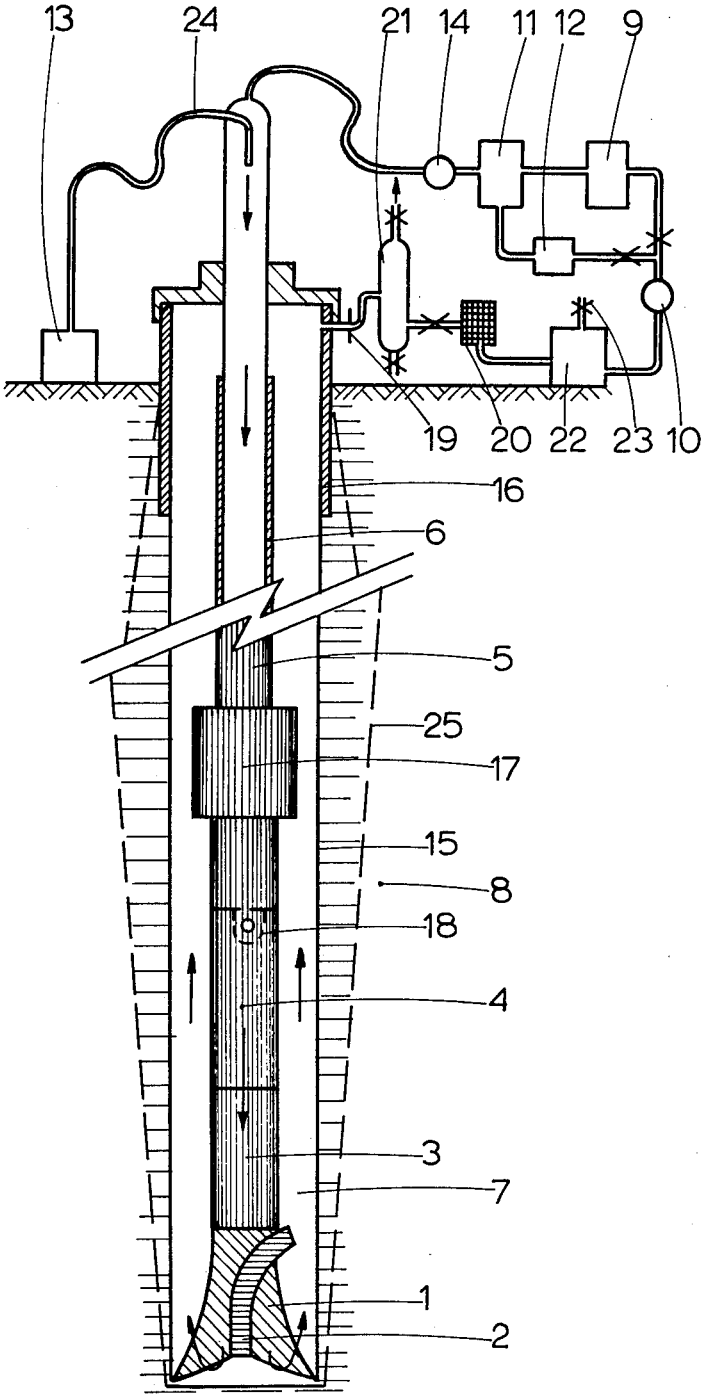
FIG. 2 of the drawing shows a side-view of a bore hole in progress.

According to FIG. 2 a core drill bit 1, in the process of drilling core 2, is connected via flush motor 3 (dyna motor) and drill collars or stems 4, to the hollow drilling string 5, of which the pipes are provided with insulation material 6. The motor 3 is driven by the drilling liquid. In this way a hole 7 is formed in the strata 8.

The eutectic drilling liquid or mud is prepared by changing a portion of the liquid into ice in the ice-machine 9, which ice is led to suction tank 11 to be there mixed with the aqueous salt solution which is cooled in the cooling device 12 and also transported to the tank 11. The mixture is suctioned by another pump 14 and flows downwards through the string 5 and into bit 1, through apertures and, subsequently, upwards via the annular circuit between string 5 and drill hole wall 15, resp. conductor 16.

The drilling string is also provided with one or more packers 17 capable of shutting of the annular circuit against the frozen wall of the drill hole 15. The hollow drill pipes can be shut off automatically with non-return valve 18, if the liquid should try to flow back.

In the connection between the conductor 16 and shaking screen 20 a throttling element 19 is present, followed by a separator 21 in which gas is recovered from the liquid or mud. Drill cuttings or drill bit cores, and ice, if any, if these have not been collected in separator 21, are removed from the drilling liquid on shaking screen 20, whereupon the flush, via collecting tank 22, can be pumped by means of pump 10 through the ice-machine 9 or, possibly, through the cooling device 12. Extra flush and chemicals may be added via line 23 in the collecting tank 22. Finally, air may be added via compressor 13 through line 24 in the drilling string 5.

The frozen formation around the drill hole is indicated schematically by dotted line 25. The drilling equipment is operated at the ground level by a conventional hoist, as is known for instance from the oil industry. Normally speaking, with use of this method this hoist may be of a smaller capacity at similar depths than is the case if the usual methods are applied.

EXAMPLE

The invention is further elucidated with a non-limiting, numerical example (expressed in S.I. units).

A drill hole having a depth of 1500 m is drilled to a diameter of 127 mm (5") with the aid of a diamond drill bit lined with diamond board. The length of the drill bit, drill collars and dyna-drill amounts to approximately 10 m (393'). The drilling line consists of light-weight pipes of about 3 kg/m (6.825 lbs/ft), dia. 73 mm ($2\frac{7}{8}$"), provided with an insulation jacket measuring 12.7 mm ($\frac{1}{2}$") in thickness, so that the overall diameter is 98 mm ($3\frac{7}{8}$"). The insulation value of the jacket is equal to 0.3 W (mK) ($50.10^{-6}$BTU/sec.ft.° F.).

The drilling rate amounts on an average to 3 mm/sec (0.01 ft/sec). The rock temperature at the bottom, at a surface temperature of 10° C. (50° F.), is 55° C. (131° F.).

The drilling liquid has the following composition:

| | |
|---|---|
| NaCl | 296 g per liter of water |
| Attapulgite | 40 g per liter of water |
| Floc gel | 15 g per liter of water |
| Mass density (specific gravity) | 1200 kg/m$^3$ |
| Plastic viscosity | 7 mPa.s at +20° C. |
| " | 21 mPa.s at −20° C. |
| Apparent viscosity | 9 mPa.s at +20° C. |
| " | 24.5 mPa.s at −20° C. |

Said drilling mud contains 10% by volume of ice of the same composition. The mud is circulated at a quantity of 8.2 liters/sec (130 gallons/min.), entering the drill hole having a temperature of −20° C. (−4° F.) and returning having a temperature of −10° C. (−1° F.). The amount of heat to be discharged (=supply of frigories) should be about 530 kJ/s (500 BTU/sec).

The liquid pressure at the base of the drill hole amounts to 17.6 MPa (2550 p.s.i.) and to 14.8 MPa (2150 p.s.i.) with addition of air or nitrogen. The pressure on the throttling element at the top of the annular space will amount to approximately 12 MPa (1740 p.s.i.).

We claim:

1. In a process for drilling holes in the earth's crust through strata containing unconsolidated earth formations utilizing a hollow drilling string extending the length of said hole and terminating at its lower end with a drill bit, wherein a mud containing drilling fluid is cooled to a temperature below the freezing point of water contained in said earth formations and introduced into the upper portion of said drilling string and circulated through said hole in contact with said earth formations, the improvement essentially comprising the combination of:

drilling said hole utilizing a drill bit adapted for drilling through hard rock formations;
forming a cold drilling liquid containing solid particles of a frozen aqueous medium;
introducing said frozen particle containing cold drilling liquid into the upper portion of said drilling string; and
circulating said cold drilling liquid to the bottom of said hole through said drilling string and into contact with said unconsolidated earth formations thereby causing at least a portion of said solid particles of frozen aqueous medium to melt;

said circulating cold drilling liquid having sufficient frigories to solidify said unconsolidated earth formations at the bottom of said hole by freezing said water contained in said formations at a rate and depth sufficently in advance of said drill bit whereby balling is substantially avoided.

2. The process of claim 1 wherein said strata additionally contain hard rock formations and said drill bit adapted for drilling through hard rock formations is used when drilling in both said hard rock formations and said unconsolidated earth formations.

3. The process of claim 1 wherein said drilling liquid is an organic liquid initially containing particles of said frozen aqueous medium.

4. The process of claim 3 wherein said drilling liquid is an emulsion of an aqueous medium in an oil, wherein said aqueous medium is initially present in said cold drilling liquid as a frozen solid.

5. The process of claim 4 wherein said aqueous medium is an aqueous salt siolution of approximately eutectic composition.

6. The process of claim 1 wherein said cold drilling liquid is an aqueous salt solution of approximately eutectic composition initially containing frozen particles of approximately the same composition.

7. The process of claim 6 wherein means are provided for the continuous control of the salt content of said aqueous salt solution.

8. The process of claim 6 wherein said salt is NaCl, $MgCl_2$ or $CaCl_2$.

9. The process of claim 1 wherein said cold drilling fluid containing solid particles of a frozen aqueous medium is formed in cooling means located outside of said hole and is circulated through said drilling string to the bottom of said hole and back to said cooling means through the annular space between the outside of said drilling string and the formation surrounding said hole, wherein at least a portion of said solid particles of frozen liquid formed in said cooling means melt during the course of said circulation.

10. The process of claim 9 wherein the pressure exerted by said drilling liquid at the bottom of said hole is regulated by the flow of said drilling liquid through the upper portion of said annular space.

11. The process of claim 1 or 9 wherein the pressure exerted by said drilling liquid upon the formations surrounding said hole is controlled to approximately the same or less than the pressure exerted by the water contained in said formations.

12. The process of claim 11 wherein the mass density of the drilling liquid in said annular space is reduced by causing to be admixed with such drilling liquid a material of lesser density.

13. The process of claim 12 wherein the mass density of the drilling liquid is reduced by adding a low density liquid immiscible in, and capable of forming an emulsion with, said drilling liquid.

14. The process of claim 12 wherein the mass density of the drilling liquid in said annular space is reduced by the presence of gas in the drilling liquid in said annular space.

15. The process of claim 14 wherein said gas results from the vaporization of a liquid added to said drilling liquid in a cooled liquid state.

16. The process of claim 12 wherein said drilling liquid and said gas are in the form of a foam.

17. The process of claim 16 wherein a stabilizer is added to said drilling liquid to promote the stability of said foam.

18. The process of claim 1 wherein said mud is a cold resistant shale material.

19. The process of claim 18 wherein said cold resistant shale material is attapulgite in the presence of floc gel.

20. In a drilling apparatus for drilling a hole in the earth's crust with simultaneous circulation of a cold drilling fluid through said hole, said apparatus comprising a hollow drill string extending to the bottom of said hole and terminating with a drill bit at its lower end and forming an annular space between said drill string and the wall of said hole, drilling means for causing said drill bit to rotate to effect said drilling, cooling means for forming a cold drilling liquid, circulating means for introducing said cold drilling liquid into the upper end of said hollow drill string and causing it to flow down through said drill string exiting said drill string in the vicinity of said drill bit, and to flow upward through said annular space and back to said cooling means, the improvement wherein said cooling means is comprised of a cooler adapted to cool at least a portion of said drilling liquid, an ice machine adapted to freeze a portion of said drilling liquid, and mixing means adapted to form a mixture of frozen drilling liquid with cooled drilling liquid for circulation through said hole.

21. The apparatus of claim 20 wherein said cooler, said ice machine and said mixing means are combined in a single apparatus adapted to cool said drilling liquid while freezing a portion thereof.

* * * * *